United States Patent [19]

Shinzawa et al.

[11] Patent Number: 4,538,413

[45] Date of Patent: Sep. 3, 1985

[54] PARTICLE REMOVING SYSTEM FOR AN INTERNAL COMBUSTION ENGINE

[75] Inventors: Motohiro Shinzawa; Motomi Arai; Shomatsu Roppongi, all of Yokosuka; Kichihiko Dozono, Kagoshima; Yoji Hasegawa, Yokohama, all of Japan

[73] Assignee: Nissan Motor Company, Limited, Japan

[21] Appl. No.: 552,303

[22] Filed: Nov. 15, 1983

[30] Foreign Application Priority Data

Nov. 19, 1982 [JP] Japan ..... 57-201825

[51] Int. Cl.[3] ..... F01N 3/02

[52] U.S. Cl. ..... 60/303; 60/311; 431/248

[58] Field of Search ..... 60/274, 286, 303, 311; 431/248; 60/738; 55/DIG. 30

[56] References Cited

U.S. PATENT DOCUMENTS

| | | | |
|---|---|---|---|
| 1,052,588 | 2/1913 | Janicki | 60/738 |
| 4,424,671 | 1/1984 | Tokura | 60/274 |
| 4,459,805 | 7/1984 | Kamiya | 60/311 |

FOREIGN PATENT DOCUMENTS

| | | | |
|---|---|---|---|
| 54-12029 | 1/1979 | Japan . | |
| 56-115809 | 9/1981 | Japan . | |
| 57-136814 | 8/1982 | Japan . | |
| 657789 | 9/1951 | United Kingdom | 60/738 |

*Primary Examiner*—Douglas Hart

*Attorney, Agent, or Firm*—Lowe, King, Price & Becker

[57] ABSTRACT

An exhaust passage extends from an internal combustion engine to conduct exhaust from the engine. A filter is disposed in the exhaust passage to catch particles in the exhaust. A burner is disposed in the exhaust passage at a position upstream of the filter. The burner receives a mixture of air and fuel and burns the mixture to burn off the particles deposited on the filter. The burner includes a vaporizing member and a guide member.

5 Claims, 11 Drawing Figures

PARTICLE REMOVING SYSTEM FOR AN INTERNAL COMBUSTION ENGINE

BACKGROUND OF THE INVENTION

1. Field of the Invention

This invention relates to a system for removing particles from exhaust produced by internal combustion engines, such as diesel engines.

2. Description of the Prior Art

Exhaust produced by diesel engines has a relatively high content of polluting particles composed of carbon, unburned fuel, and partially burned fuel. Filters or traps are conventionally disposed in engine exhaust systems to remove the particles from the exhaust. In this case, burners positioned in the exhaust systems upstream of the filters are usually employed to burn off particles deposited on the filters to unclog and rejuvenate the filters.

Japanese published patent applications 54-12029 and 56-115809, and Japanese utility model application 56-22107 (publication number 57-136814) disclose such burners. Burning the fuel supplied to these burners uses oxygen contained in the exhaust. Under heavy engine load conditions, the oxygen concentration in the exhaust may be inadequate to completely burn the supplied fuel. If the burners are activated under such engine operating conditions, a large amount of unburned fuel can, therefore, be discharged into the atmosphere.

SUMMARY OF THE INVENTION

It is an object of this invention to provide a particle removing system for an internal combustion engine which can operate effectively under any engine operating conditions.

In accordance with this invention, a particle removing system is applied to an internal combustion engine from which an exhaust passage extends to conduct exhaust from the engine. The system includes a device to produce a mixture of air and fuel. The system also includes a filter and a burner. The filter is disposed in the exhaust passage to catch particles in the exhaust and thereby separate the particles from gas in the exhaust. The burner is disposed in the exhaust passage upstream of the filter. The burner is connected to the mixture producing device to receive and burn the mixture in order to burn off the particles deposited on the filter. The burner includes a combustion member, a mixture pipe, a vaporizing member, and an igniting device. The combustion member defines a combustion chamber therein and has a downstream end defining an outlet opening connecting the combustion chamber to the exhaust passage. The mixture pipe is connected to the mixture producing device to conduct the mixture from the latter. The mixture pipe extends through the combustion member and into the combustion chamber. The mixture pipe has an end in the combustion chamber. The end of the mixture pipe defines an outlet opening to discharge the mixture. The vaporizing member is disposed in the combustion chamber and surrounds the mixture pipe. The vaporizing member and the mixture pipe define a first space therebetween to which the outlet opening of the mixture pipe is exposed. The vaporizing member has an opening communicating with the first space. The mixture can flow from the outlet opening of the mixture pipe to the opening of the vaporizing member via the first space and then flow out of the vaporizing member via the opening of the vaporizing member. The guide member is disposed in the combustion chamber and surrounds at least the part of the vaporizing member defining the opening thereof. The guide member and the vaporizing member define a second space therebetween to which the opening of the vaporizing member is exposed. The guide member has an outlet opening connecting the second space to the combustion chamber. The mixture can flow from the opening of the vaporizing member to the outlet opening of the guide member via the second space and then flow out of the guide member into the combustion chamber via the outlet opening of the guide member. The igniting device serves to ignite the mixture in the second space.

BRIEF DESCRIPTION OF THE DRAWINGS

Corresponding and like elements are denoted by the same reference numerals or characters throughout the drawings.

DESCRIPTION OF THE PREFERRED EMBODIMENTS

Figure 1:
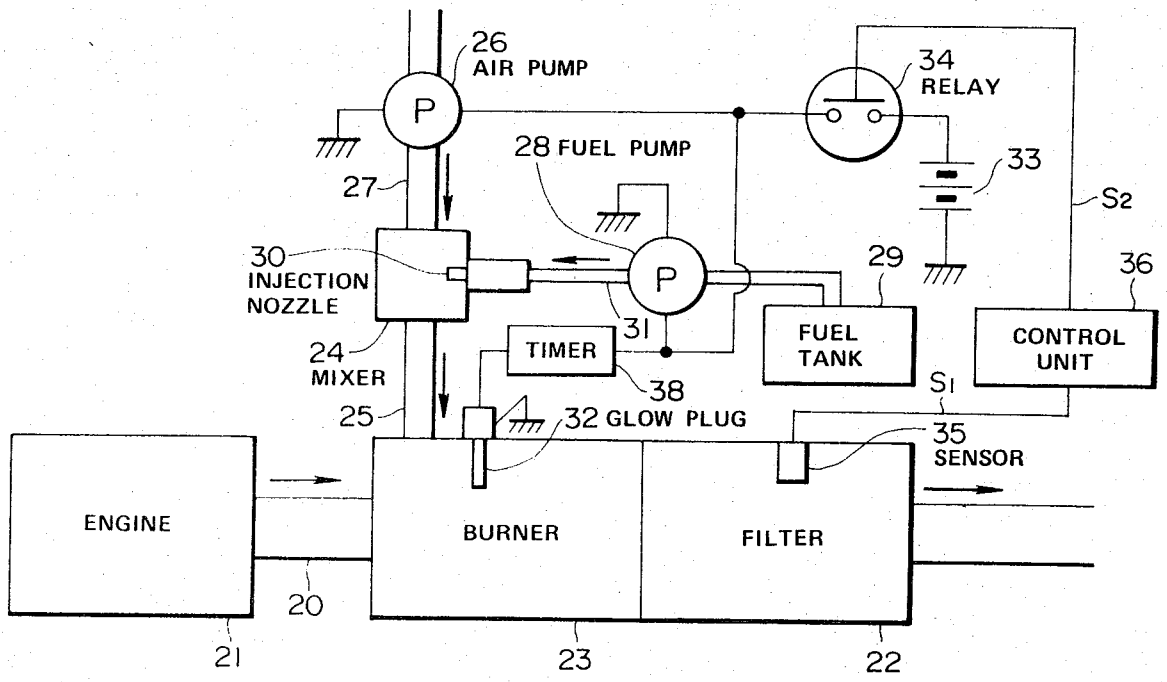
FIG. 1 is a diagram of a particle removing system for an internal combustion engine according to this invention.

With reference to FIG. 1, an exhaust passage 20 extends from an internal combustion engine 21, such as a diesel engine, to conduct exhaust from the engine 21 to the atmosphere. A filter or trap 22 is disposed in the exhaust passage 20 to remove polluting particles composed of carbon, unburned fuel, and partially burned fuel from the exhaust. These particles are suspended in the exhaust gas. Specifically, the filter 22 serves to catch these particles and thereby separate them from the exhaust gas.

A burner 23 is positioned in the exhaust passage 20 upstream of the filter 22 to burn off the particles retained and collected by the filter 22 in order to unclog and rejuvenate the filter 22. The burner 23 is connected to a mixer 24 via a mixture passage 25 to receive an air/fuel mixture from the mixer 24. An electriclly-powered air pump 26 serves to supply air to the mixer 24 via an air passage 27. An electrically-powered fuel pump 28 serves to draw fuel from a fuel tank 29 and then drives the fuel toward a fuel injection nozzle 30 via a fuel line 31. The nozzle 30 opens into the mixer 24 to inject the fuel into the mixer 24. In the mixer 24, the air and the fuel mix to form the air/fuel mixture. An electrically-powered heater or glow plug 32 is positioned in the burner 23 to ignite the air/fuel mixture in the burner 23.

The air pump 26 and the fuel pump 28 are electrically connected across DC electrical power source 33 via the switch of a common relay 34. These pumps 26 and 28 are electrically energized and de-energized when the relay switch is closed and opened respectively. The relay 34 has a control winding. When the relay control winding is electrically energized and de-energized, the relay switch is closed and opened respectively.

A sensor 35 disposed in the filter 22 serves to sense the amount or level of particles retained by the filter 22 and generate an electrical signal $S_1$ indicative thereof. A control unit 36 is electrically connected to the sensor 35 to receive the signal $S_1$. The control unit 36 generates another electric signal $S_2$ which changes in accordance with the signal $S_1$. Specifically, the control unit 36 compares the signal $S_1$ to an internally-produced reference signal representing a first predetermined amount of particles. When the sensed amount of particles exceeds the first predetermined reference level, the control unit 36 changes the signal $S_2$ from a low level to a high level. After the signal $S_2$ changes to the high level and while the signal $S_2$ remains at the high level, the control unit 36 compares the signal $S_1$ to another internally-produced reference signal representing a second predetermined amount of particles which is smaller than the first predetermined reference level. When the sensed amount of particles drops below the second predetermined reference level, the control unit 36 returns the signal $S_2$ from the high level to the low level. After the signal $S_2$ returns to the low level and while the signal $S_2$ remains at the low level, the control unit 36 again compares the signal $S_1$ to the reference signal representing the first predetermined amount of particles. The control winding of the relay 34 is electrically connected to the control unit 36 to receive the signal $S_2$. When the signal $S_2$ assumes the high level and the low level, the relay control winding is electrically energized and de-energized respectively.

The input terminal of a monostable multivibrator or timer 38 is electrically connected to the junction between the switch of the relay 34 and the pumps 26 and 28. The output terminal of the timer 38 is electrically connected to the glow plug 32. When the relay switch is closed, a positive-going voltage change is induced and applied to the timer 38, thereby triggering the timer 38. When triggered, the timer 38 outputs a high level voltage which electrically energizes the glow plug 32. The timer 38 maintains the high level voltage and thus the electrical energization of the glow plug 32 for a preset length of time. After this preset length of time, the timer 38 outputs a low level voltage which electrically de-energizes the glow plug 32.

While the sensed amount of particles is equal to or lower than the first predetermined reference level, the signal $S_2$ remains at the low level and hence the switch of the relay 34 remains opened. In this case, the air pump 26, the fuel pump 28, and the glow plug 32 remain electrically de-energized. While the air pump 26 and the fuel pump 28 remain electrically de-energized, the mixer 24 does not receive any air from the pump 26 nor any fuel from the pump 28, i.e., no air/fuel mixture is supplied by the mixer 24 to the burner 23. Accordingly, the burner 23 remains de-activated in this case. While the burner 23 remains de-activated, the glow plug 32 also remains electrically de-energized.

When the sensed amount of particles exceeds the first predetermined reference level, the signal $S_2$ changes to the high level and hence the switch of the relay 34 is closed. The closing of the relay switch allows the air pump 26, the fuel pump 28, and the glow plug 32 to be electrically energized. As a result, the pump 26 drives air into the mixer 24 and the pump 28 drives fuel into the mixer 24, so that air/fuel mixture results in the mixer 24 and is then supplied by the mixer 24 to the burner 23. The energized glow plug 32 ignites the air/fuel mixture in the burner 23. The burning air/fuel mixture produces adequately hot combustion gas. This hot gas flows into the filter 22, heating and burning off the particles retained by the filter 22 to unclog and rejuvenate the filter 22. After the preset length of time from the initiation of the energization of the glow plug 32, the timer 38 allows the glow plug 32 to be electrically de-energized.

When the sensed amount of particles drops below the second predetermined reference level smaller than the first predetermined reference level as a result of the burning off of the particles retained by the filter 22, the signal $S_2$ returns to its low level and hence the switch of the relay 34 is opened. The opening of the relay switch allows the air pump 26, the fuel pump 28, and the glow plug 32 to be electrically de-energized again, so that the burner 23 is again de-activated.

The details of the sensor 35 and of the control unit 36 are shown in U.S. patent application Ser. No. 340,290, entitled "EXHAUST GAS PURIFICATION APPARATUS", the disclosure of which is hereby incorporated by reference.

Figure 2:
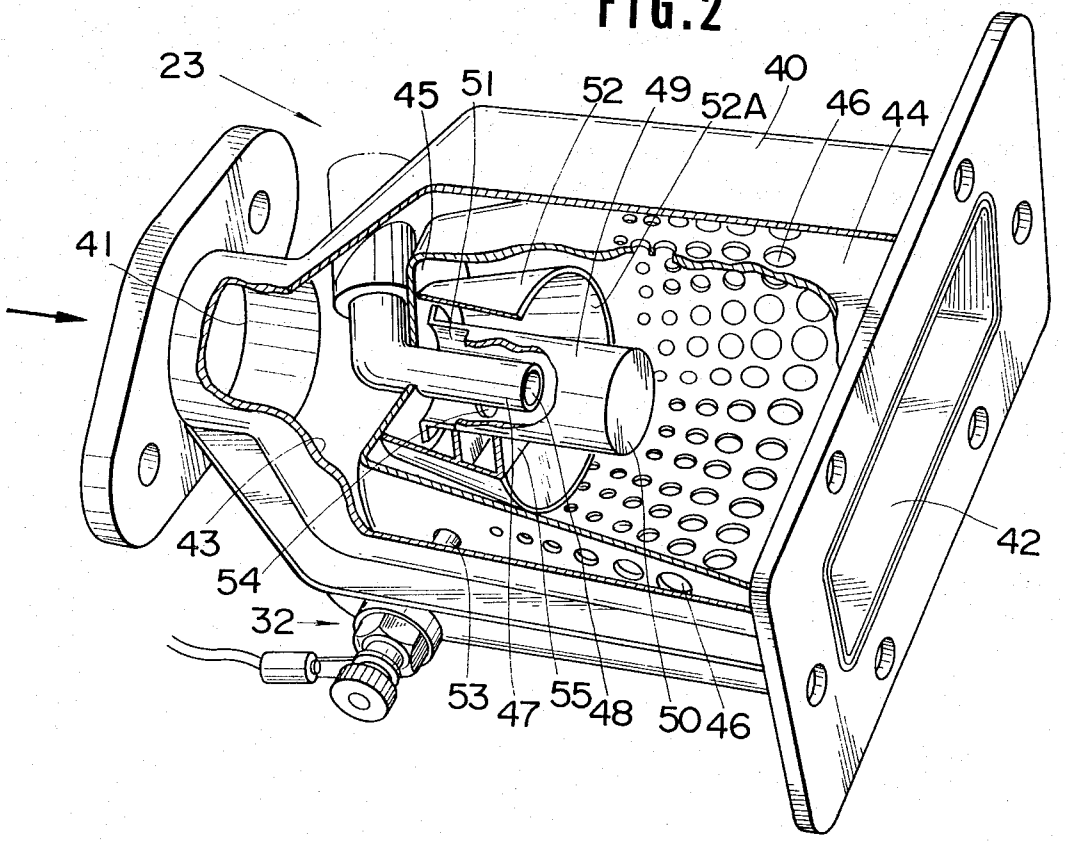
FIG. 2 is a perspective view, with portions broken away for clarity, of the burner of FIG. 1.

FIG. 2 shows the details of the burner 23. A casing or housing 40 has an inlet opening 41, an outlet opening 42, and a passage 43 extending between the openings 41 and 42 and forming part of the exhaust passage 20 (see FIG. 1). A combustion tube or cylinder 44 is fixedly disposed in the casing 40 in such a manner that one end of the combustion cylinder 44 opposes the inlet opening 41 and the other end is positioned near the outlet opening 42. The walls of combustion cylinder 44 define a combustion chamber in the cylinder 44. The end of the combustion cylinder 44 near the outlet opening 42 defines another outlet opening connecting the combustion chamber to the outlet opening 42. The end of the combustion cylinder 44 opposing the inlet opening 41 is closed by a circular end plate 45 integral with the combustion cylinder 44. The cylindrical walls of the combustion cylinder 44 are radially spaced from the inner surface of the casing 40. A plurality of apertures 46 extend through the cylindrical walls of the combustion cylinder 44. Exhaust gas enters the casing 40 via the inlet opening 41, passes through the spacing between the casing 40 and the combustion cylinder 44, and finally flows into the combustion cylinder 44 via the apertures 46. The periphery of the end of the combustion cylinder 44 near the outlet opening 42 is formed with an annular flange (not shown), which sealingly contacts the inner surface of the casing 40 to close the gap between the casing 40 and the combustion cylinder 44 and thereby to force all of the exhaust gas to flow into the combustion cylinder 44 via the apertures 46.

A pipe 47 defining the downstream end of the mixture passage 25 (see FIG. 1) extends through the walls of the casing 40 and through the center of the end plate 45, and extends coaxially into the combustion cylinder 44. The end of mixture pipe 47 in the combustion cylinder 44 defines an outlet opening 48 through which the air/fuel mixture can flow into the combustion cylinder 44. The casing 40 and the end plate 45 support the mixture pipe 47.

A vaporizing member in the form of a hollow cylinder 49 disposed in the combustion cylinder 44 is attached to the end plate 45. The vaporizing cylinder 49 coaxially surrounds the portion of the mixture pipe 47 extending into the combustion cylinder 44. One end of the vaporizing cylinder 49 is sealed by the end plate 45. The other end of the vaporizing cylinder 49 is closed by a circular end plate 50. The inside diameter of the vaporizing cylinder 49 is greater than the outside diameter of the mixture pipe 47 and the axial length of the vaporizing cylinder 49 is greater than the axial length of the portion of the mixture pipe 47 extending into the combustion cylinder 44, so that the vaporizing cylinder 49 and the mixture pipe 47 define a gap or space therebetween to which the mixture outlet opening 48 is exposed. The end of the vaporizing cylinder 49 near the end plate 45 has an opening 51 communicating with the space between the mixture pipe 47 and the vaporizing cylinder 49. The air/fuel mixture can flow out of the mixture pipe 47 into the space between the mixture pipe 47 and the vaporizing cylinder 49 via the outlet opening 48 and can then pass through this space before exiting from the vaporizing cylinder 49 via the opening 51. This movement involves at least reversal of air/fuel mixture flow in the space between the mixture pipe 47 and the vaporizing cylinder 49.

A guide tube 52 disposed in the combustion cylinder 44 is supported on the end plate 45. The guide tube 52 coaxially surrounds the vaporizing cylinder 49. One end of the guide tube 52 is sealed by the end plate 45. The other end of the guide tube 52 opens into the combustion chamber as indicated by the reference character 52A. The inside dimensions of the guide tube 52 are greater than the outside dimensions of the vaporizing cylinder 49, so that the guide tube 52 and the vaporizing tube 49 define an annular gap or space therebetween to which the opening 51 of the vaporizing cylinder 49 is exposed and which leads to the end opening 52A. The axial length of the guide tube 52 is smaller than that of the vaporizing cylinder 49 so that the vaporizing cylinder 49 axially projects from the guide tube 52. The opening 51 of the vaporizing cylinder 49 is completely concealed by the guide tube 52. In other words, the guide tube 52 surrounds at least the part of the vaporizing cylinder 49 defining the opening 51. The air/fuel mixture can flow out of the vaporizing cylinder 49 into the space between the vaporizing cylinder 49 and the guide tube 52 via the opening 51, and can then pass through this space before entering the combustion cylinder 44 via the end opening 52A of the guide tube 52. This movement involves an additional reversal of air/fuel mixture flow at and around the opening 51.

The glow plug 32 has a support 53 attached to the casing 40. The support 53 extends into the space between the vaporizing cylinder 49 and the guide tube 52. The glow plug 32 has a working element which is mounted on the support 53 so as to reside in the space between the vaporizing cylinder 49 and the guide tube 52. Thus, the guide tube 52 conceals the working element of the glow plug 32. The glow plug 32 serves to ignite the air/fuel mixture flowing through the space between the vaporizing cylinder 49 and the guide tube 52.

The axial length of the guide tube 52 is smaller than the axial length of the combustion cylinder 44. The apertures 46 of the combustion cylinder 44 are located such that the guide tube 52 does not conceal the apertures 46. The inside diameter of the guide tube 52 increases in the axial direction from its closed end to its open end 52A so that the tube 52 is in the form of a tapered cylindrical shell or a truncated cone shell. The guide tube 52 prevents the exhaust gas in the combustion cylinder 44 from coming into direct contact with the working element of the glow plug 32. In this way, the exhaust gas is prevented from adversely interfering with the ignition of the air/fuel mixture by the glow plug 32. Note that the exhaust gas may contain an inadequately small percentage of oxygen under certain engine operating conditions as suggested previously.

The vaporizing cylinder 49 has an aperture 54 at a position radially opposing the working element of the glow plug 32. A portion of the air/fuel mixture can exit from the vaporizing cylinder 49 via the aperture 54 and can then directly reach or pass around the working element of the glow plug 32. This air/fuel mixture glow prevents the exhaust gas from approaching the working element of the glow plug 32. A cover 55 fixed to the vaporizing cylinder 49 resides in the space between the vaporizing cylinder 49 and the guide tube 52. The cover 55 extends perpendicularly to the axis of the vaporizing cylinder 49 and has a U-shaped cross-section. The cover 55 and the vaporizing cylinder 49 define a space with a rectangular cross-section into which the aperture 54 directly opens and in which the working element of the glow plug 32 is positioned. An opening or openings (not shown) are formed through the walls of the cover 55, so that the interior of the cover 55 communicates with the space between the vaporizing cylinder 49 and the guide tube 52. The cover 55 conceals the working element of the glow plug 32 to reliably prevent the exhaust gas from reaching the working element.

In the operation of the burner 23, after passing along the mixture pipe 47, the air/fuel mixture flows into the space between the mixture pipe 47 and the vaporizing cylinder 49 via the outlet opening 48. The air/fuel mixture then passes through this space toward the opening 51 and the aperture 54 before exiting from this space via the opening 51 and the aperture 54 and entering the space between the vaporizing cylinder 49 and the guide tube 52. Thereafter, the air/fuel mixture passes the space between the vaporizing cylinder 49 and the guide tube 52 and is ignited by the glow plug 32. Ignited by the glow plug 32, the air/fuel mixture fans out of the guide tube 52 into the combustion cylinder 44 via the end opening 52A and burns in the combustion cylinder 44. The burning air/fuel mixture uses oxygen in the exhaust gas in addition to oxygen in the air of the mixture. The resulting hot combustion gas flows out of the burner 23 into the filter 22 (see FIG. 1) via the outlet opening 42 and then burns off the particles retained by the filter 22.

Since the vaporizing cylinder 49 projects from the guide tube 52, the vaporizing cylinder 49 is greatly heated and made red-hot by the burning air/fuel mixture in the combustion cylinder 44. The red-hot vaporizing cylinder 49 serves to sustain ignition of the air/fuel mixture. The glow plug 32 remains electrically energized only for the preset length of time defined by the timer 38 (see FIG. 1). After this preset interval, the red-hot vaporizing cylinder 49 ignites the air/fuel mixture in place of the glow plug 32. If a portion of fuel in the mixture deposits on or adheres to the inner surface of the vaporizing cylinder 49, the fuel will immediately be vaporized by the heat of the vaporizing cylinder 49. Since the inside diameter of the guide tube 52 increases in the axial direction toward the open end 52A, the guide tube 52 serves as a diffuser promoting mixing of the air/fuel mixture. Since the guide tube 52 and the cover 55 prevent the exhaust gas from reaching the working element of the glow plug 32, misfiring and incomplete combustion of the air/fuel mixture are reliably prevented. Note that the exhaust gas may contain an inadequately small percentage of oxygen under certain engine operating conditions as suggested previously. The air/fuel mixture thus completely and reliably burns under any engine operating conditions, including heavy engine load conditions in which the exhaust gas contains an inadequately small percentage of oxygen.

Figure 3:
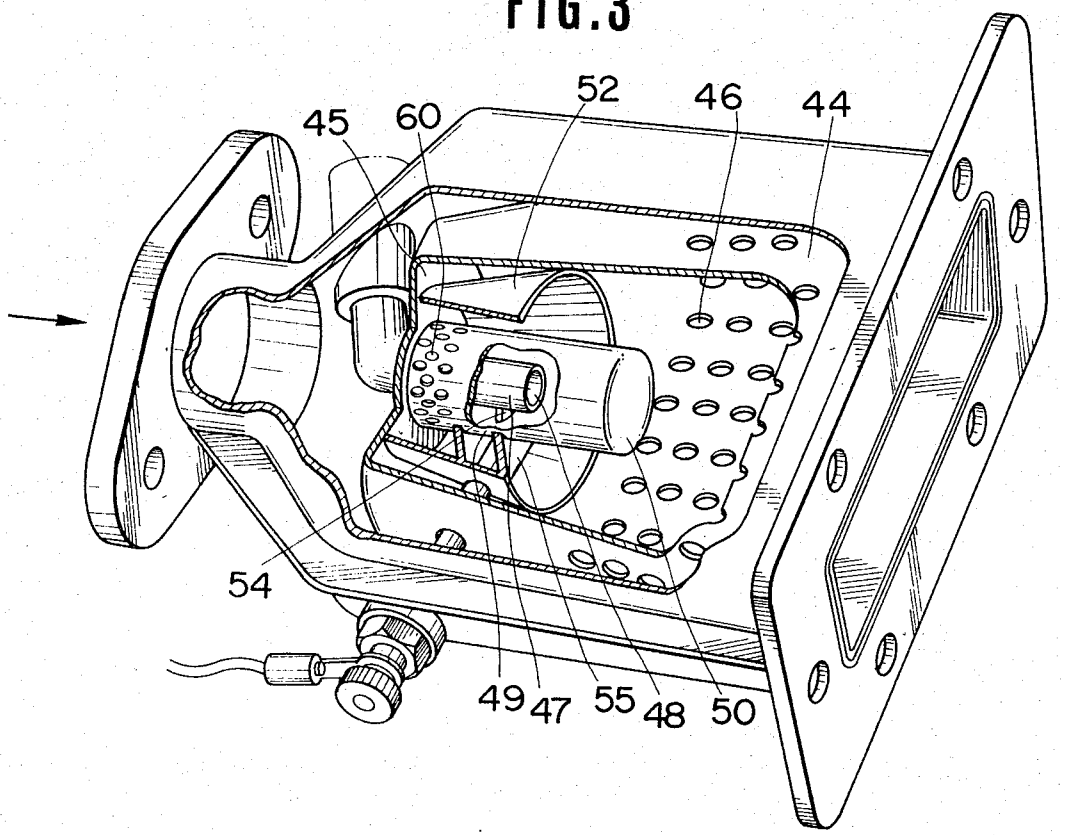
FIG. 3 is a perspective view, with portions broken away for clarity, of a burner including a first modified vaporizing cylinder.

FIG. 3 shows a first modification of the vaporizing cylinder 49. In this modification, the vaporizing cylinder 49 has a plurality of apertures 60 in place of the opening 51. The sum of the cross-sectional areas of these apertures 60 is chosen to be smaller than the effective cross-sectional area of the space between the mixture pipe 47 and the vaporizing cylinder 49 in order to accelerate the air/fuel mixture flow. This accelerated mixture flow more reliably prevents the exhaust gas from reaching the working element of the glow plug 32.

Figure 4:
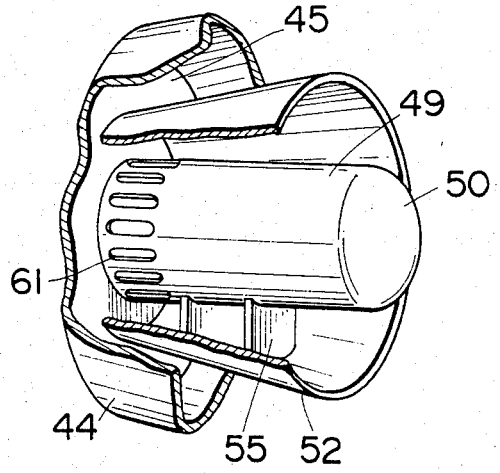
FIG. 4 is a perspective view, with portions broken away for clarity, of an essential part of a burner including a second modified vaporizing cylinder.

FIG. 4 shows a second modification of the vaporizing cylinder 49. In this modification, the vaporizing cylinder 49 has a plurality of axial slits 61 in place of the apertures 60. These slits 61 are spaced circumferentially at equal angular intervals.

Figure 5:
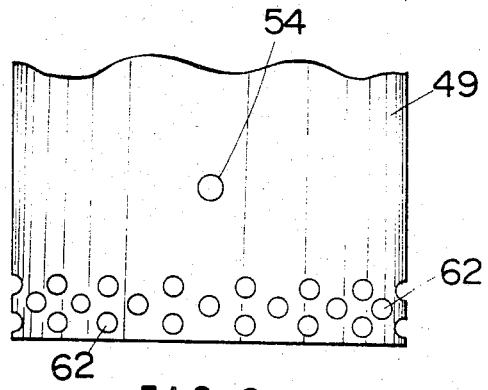
FIG. 5 is a plan view of a third modified vaporizing cylinder.

FIG. 5 shows a third modification of the vaporizing cylinder 49. In this modification, the vaporizing cylinder 49 has a plurality of apertures 62 of equal cross-sectional area. The apertures 62 are more densely distributed along the upper side of the cylinder 49 than along the lower side of the cylinder 49, so that the upper side of the cylinder 49 has a larger total flow cross-section than the lower side of the cylinder 49. In the case where the fuel consists of a petroleum product having a relatively high boiling point, the fuel is liable to inadequately vaporize and so collect as a liquid below the lower side of the cylinder 49 during high-speed, smalll-oad engine operation in which the temperature of the exhaust gas is relatively low and the flow rate of the exhaust gas is relatively great. The accumulating fuel can cause a circumferentially nonuniform distribution of the air/fuel mixture, resulting in a nonuniform distribution of mixture-combustion heat and thus causing the particles deposited on the filter 22 (see FIG. 1) to be unevenly burned off or removed. The unequal density of the apertures 62 will offset such a nonuniform distribution of air/fuel mixture and will therefore allow the particles deposited on the filter 22 to be burned off or removed evenly.

Figure 6:
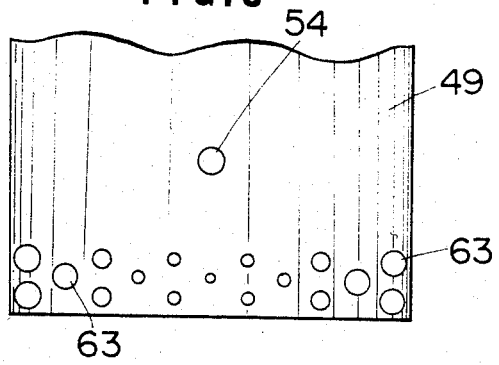
FIG. 6 is a plan view of a fourth modified vaporizing cylinder.

FIG. 6 shows a fourth modification of the vaporizing cylinder 49. In this modification, the vaporizing cylinder 49 has a plurality of apertures 63 in place of the apertures 62. These apertures 63 are uniformly distributed around the vaporizing cylinder 49. However, the cross-sectional areas of the apertures 63 increase from the bottom to the top of the vaporizing cylinder 49.

Figure 7:
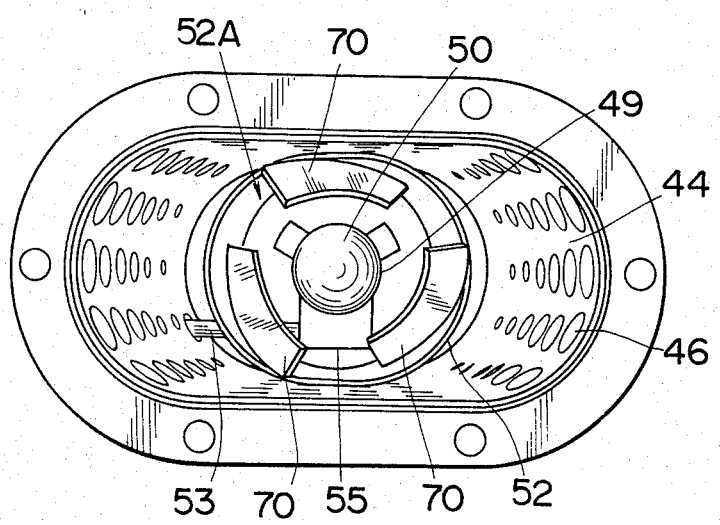
FIG. 7 is a front view of a first modified burner.
Figure 8:
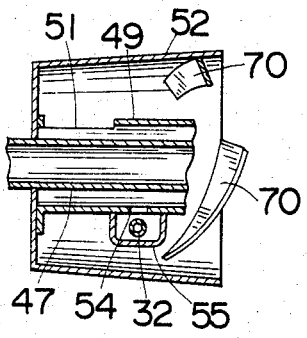
FIG. 8 is a longitudinal section view of the burner of FIG. 7.

FIGS. 7 and 8 show a first modification of the burner 23. In this modification, a plurality of vanes 70 are disposed in the open end 52A of the guide tube 52. These vanes 70 are secured to the guide tube 52. The vanes 70 induce turbulent flow in the flame or blaze, thereby promoting mixing of the flame and the exhaust gas in the combustion cylinder 44 and enhancing the uniformity of the distribution of the hot combustion gas. This increase in the uniformity allows the filter 22 (see FIG. 1) to be unclogged more completely.

Figure 9:
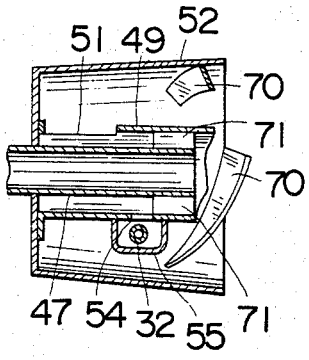
FIG. 9 is a longitudinal section view of an essential part of a second modified burner.
Figure 10:
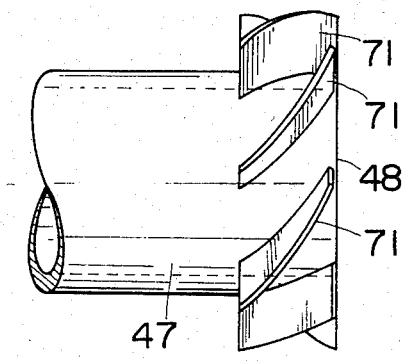
FIG. 10 is a side view of a mixture pipe and blades in the burner of FIG. 9.

FIGS. 9 and 10 show a second modification of the burner 23. In this modification, a plurality of vanes 70 are similarly provided. Furthermore, a plurality of blades 71 are disposed in the space between the mixture pipe 47 and the vaporizing cylinder 49. These blades 71 are mounted on the peripheral surface of the end of the mixture pipe 47 near the outlet opening 48. The blades 71 extend obliquely to the axis of the mixture pipe 47 so as to force the air/fuel mixture to swirl. This swirl flow promotes mixing of the air and the fuel, thereby producing a circumferentially uniform distribution of the air/fuel mixture. As a result, the air/fuel mixture can be ignited reliably and completely and uniformly burned.

Figure 11:
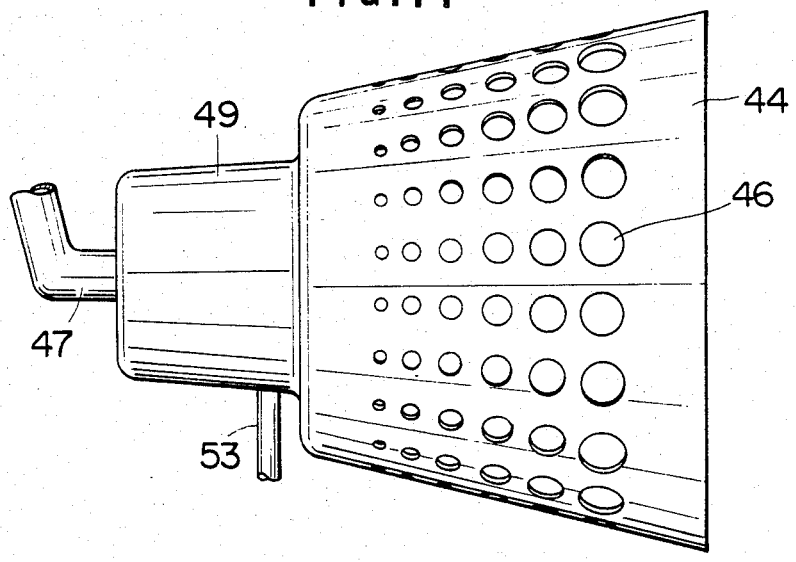
FIG. 11 is a side view of an essential part of a third modified burner.

FIG. 11 shows a third modification of the burner 23. In this modification, the outside diameter of the upstream end of the combustion cylinder 44 is reduced stepwise. The guide tube 52 is formed integrally with the combustion cylinder 44.

What is claimed is:

1. A particle removing system for an internal combustion engine from which an exhaust passage extends to conduct exhaust from the engine, the system comprising:

(a) means for producing a mixture of air and fuel;

(b) a filter disposed in the exhaust passage for catching particles in the exhaust and thereby separating the particles from gas in the exhaust; and (c) a burner disposed in the exhaust passage at a position upstream of the filter, the burner being connected to the mixture producing means for receiving the mixture, the burner being operative to burn the mixture and thereby burn off the particles caught by the filter;

the burner comprising:

(1) a casing defining a part of the exhaust passage;

(2) a combustion liner disposed within the casing and having a closed upstream end and an open downstream end attached to the casing, the combustion liner having peripheral walls spaced from the casing and formed with a plurality of apertures through which the exhaust flows into the combustion liner;

(3) a mixture pipe, connected to the mixture producing means and extending into the combustion liner through walls of the casing and the combustion liner, for conducting the mixture into the combustion liner;

(4) a vaporizing tube disposed within the combustion liner and surrounding an outlet of the mixture pipe, the vaporizing tube and the mixture pipe defining a first space therebetween, the vaporizing tube having closed first and second ends, the closed first end of the vaporizing tube being operative to reverse the direction of the mixture flow to promote vaporization of the fuel in the mixture, the vaporizing tube having an outlet near its closed second end, whereby the mixture flows from the outlet of the mixture pipe to the outlet of the vaporizing tube through the first space;

(5) a guide tube disposed within the combustion liner and surrounding at least the part of the vaporizing tube defining the outlet thereof, the guide tube and the vaporizing tube defining a second space therebetween, the guide tube having a closed end and an open end, the guide tube being operative to guide the mixture from the outlet of the vaporizing tube into the combustion liner through the second space and the open end of the guide tube; and (6) a glow plug extending into the second space for igniting the mixture in the second space.

2. A particle removing system as recited in claim 1, wherein the cross-sectional area of the outlet of the vaporizing tube is smaller than the minimum cross-sectional area of the first space.

3. A particle removing system as recited in claim 1, further comprising a plurality of vanes disposed in the second space at the open end of the guide tube for inducing turbulent flow in the flame.

4. A particle removing system as recited in claim 1, further comprising a plurality of blades disposed within the first space along the periphery of the outlet of the mixture pipe for swirling the mixture flow.

5. A particle removing system as recited in claim 7, further comprising a cover disposed within the second space for concealing the glow plug.

* * * * *